US011414880B2

(12) United States Patent
Jie et al.

(10) Patent No.: US 11,414,880 B2
(45) Date of Patent: Aug. 16, 2022

(54) REINFORCING STRUCTURE OF UNEXPIRED CONCRETE BUILDING FLOORS

(71) Applicant: Feng He Ying Zao Group Co., LTD., Nanchang (CN)

(72) Inventors: Baoru Jie, Nanchang (CN); Jiangang Jie, Nanchang (CN); Shuangxi Zhou, Nanchang (CN); Zhiyong Yao, Nanchang (CN); Wenrong Hu, Nanchang (CN); Yuchun Chen, Nanchang (CN); Wujin Tao, Nanchang (CN); Wen Liu, Nanchang (CN); Luolong Zhan, Nanchang (CN); Xin He, Nanchang (CN)

(73) Assignee: Feng He Ying Zao Group Co., LTD., Nanchang (CN)

( * ) Notice: Subject to any disclaimer, the term of this patent is extended or adjusted under 35 U.S.C. 154(b) by 79 days.

(21) Appl. No.: 17/034,889

(22) Filed: Sep. 28, 2020

(65) Prior Publication Data

US 2021/0095486 A1 Apr. 1, 2021

(30) Foreign Application Priority Data

Sep. 29, 2019 (CN) ..... 201921639412.4

(51) Int. Cl.
*E04G 23/02* (2006.01)
*E04C 3/32* (2006.01)
(Continued)

(52) U.S. Cl.
CPC ..... *E04G 23/0218* (2013.01); *E04B 1/21* (2013.01); *E04B 1/215* (2013.01); *E04B 1/58* (2013.01);
(Continued)

(58) Field of Classification Search
CPC ... E04B 1/21; E04B 1/215; E04B 1/58; E04B 5/10; E04B 5/023; E04B 5/046;
(Continued)

(56) References Cited

U.S. PATENT DOCUMENTS 4,071,996 A * 2/1978 Muto ..... E04G 23/0218 52/423
4,081,935 A * 4/1978 Wise ..... E04B 5/43 52/432
(Continued)

FOREIGN PATENT DOCUMENTS

CN 203383522 U * 1/2014
CN 103835440 A * 6/2014
(Continued)

*Primary Examiner* — Jessie T Fonseca
(74) *Attorney, Agent, or Firm* — Fitch, Even, Tabin & Flannery LLP

(57) ABSTRACT

The present invention relates to a reinforcing structure of unexpired concrete building floors used for reinforcing a concrete column, a concrete beam and a concrete floor slab. The structure has: at least one external column each of the at least one external column wrapping around the concrete column; at least one framework each wrapping around the concrete beam; a plurality of brackets fixedly mounted to the lower surface of the concrete floor slab, and a base plate disposed at the bottom of the concrete column, wherein the bottom of each of the at least one external column is fixed to the base plate, the top of each of the at least one external column is fixed to a corresponding one of the at least one framework, and the corresponding framework is fixed to the plurality of brackets along a length direction of the concrete beam.

20 Claims, 4 Drawing Sheets

(51) Int. Cl.

| | |
|---|---|
| ***E04B 1/58*** | (2006.01) |
| ***E04B 1/21*** | (2006.01) |
| ***E04C 3/34*** | (2006.01) |
| ***E04C 5/06*** | (2006.01) |
| ***E04B 5/02*** | (2006.01) |
| ***E04B 5/10*** | (2006.01) |
| ***E04B 5/04*** | (2006.01) |

(52) U.S. Cl.
CPC ..... *E04B 5/023* (2013.01); *E04B 5/046* (2013.01); *E04B 5/10* (2013.01); *E04C 3/32* (2013.01); *E04C 3/34* (2013.01); *E04C 5/06* (2013.01); *E04G 23/0288* (2013.01)

(58) Field of Classification Search
CPC ..... E04C 3/32; E04C 3/34; E04C 5/06; E04G 23/0218; E04G 23/0288
See application file for complete search history.

(56) References Cited

U.S. PATENT DOCUMENTS

| | | | | |
|---|---|---|---|---|
| 4,409,764 | A * | 10/1983 | Wilnau | E04B 1/165 52/204.2 |
| 6,247,279 | B1 * | 6/2001 | Murat | E04C 3/34 52/231 |
| 7,987,638 | B1 * | 8/2011 | Fang | E04G 23/0225 52/223.3 |
| 9,353,536 | B2 * | 5/2016 | Yamakawa | E04G 23/0225 |
| 10,822,789 | B1 * | 11/2020 | Mou | E04B 5/023 |
| 10,876,282 | B1 * | 12/2020 | Mou | E04B 1/2608 |
| 10,907,343 | B1 * | 2/2021 | Mou | E04C 3/36 |
| 10,914,061 | B1 * | 2/2021 | Mou | E04B 5/02 |
| 2004/0055234 | A1 * | 3/2004 | Mutsuyoshi | E04C 3/34 52/292 |
| 2010/0024332 | A1 * | 2/2010 | Valaire | E04B 5/43 52/250 |

FOREIGN PATENT DOCUMENTS

| | | | |
|---|---|---|---|
| CN | 206071092 | U * | 4/2017 |
| CN | 206667595 | U * | 11/2017 |
| KR | 20180090231 | A * | 4/2017 |

* cited by examiner

REINFORCING STRUCTURE OF UNEXPIRED CONCRETE BUILDING FLOORS

CROSS-REFERENCE TO RELATED APPLICATION

This application claims priority to Chinese Application No. 201921639412.4, filed Sep. 29, 2019, which is incorporated by reference herein in its entirety.

FIELD OF THE INVENTION

The present application relates to the field of construction engineering, and particularly, to a reinforcing structure for the second concrete floor and above of a building.

DESCRIPTION OF THE PRIOR ART

According to ISO 16204:2012 Durability—Service Life Design of Concrete Structures, the designed service life of concrete is classified into four categories: 5 years of designed service life for category 1, 25 years for category 2, 50 years for category 3 and 100 years for category 4. Every year, the area of newly built houses in China exceeds two billion square meters, accounting for more than 50% in the world, let alone a large number of other projects such as concrete dams and bridges. How to prolong the service life of concrete is a major subject confronting mankind. It will be a disastrous work to demolish all concrete structures reaching the end of service life. This will first lead to resource waste and then waste of manpower and material resources. A large amount of construction waste will endanger the living environment of mankind, and a great deal of dust will be produced in the process of demolition, thus greatly polluting the environment.

SUMMARY OF THE INVENTION

The present application is intended to solve the problems existing in the prior art and to provide a reinforcing structure for unexpired concrete building floors that can greatly prolong the service lives of concrete members without changing the original building functions.

In order to achieve the aforementioned objective, the following technical solution is adopted in the present application: a reinforcing structure of unexpired concrete building floors for reinforcing a concrete column, a concrete beam and a concrete floor slab, comprising: at least one external column each wrapping around the concrete column, at least one framework each wrapping around the concrete beam, a plurality of brackets fixedly mounted to a lower surface of the concrete floor slab, and a base plate disposed at the bottom of the concrete column, wherein the bottom of the external column is fixed to the base plate, the top of each of the at least one external column is fixed to a corresponding one of the at least one framework, and the corresponding framework is fixed to the plurality of brackets along a length direction of the concrete beam.

Preferably, each of the at least one external column comprises a plurality of stand columns, and the plurality of stand columns extend vertically along the concrete column and wrap around the concrete column.

Preferably, the bottom of each of the at least one external column is fixed to the base plate by welding.

Preferably, the plurality of stand columns are disposed at corners of the concrete column.

Preferably, the bottom of each of the plurality of stand columns is fixed to the base plate.

Preferably, each of the at least one external column further comprises a plurality of horizontal rods and a plurality of inclined support rods, the plurality of horizontal rods are vertically spaced apart along the concrete column and sequentially disposed between horizontally adjacent columns, and the plurality of inclined support rods are disposed between vertically adjacent horizontal rods.

Preferably, the plurality of brackets comprise a plurality of first brackets disposed along the length direction of the concrete beam and a plurality of second brackets respectively perpendicular to the plurality of first brackets, and the plurality of first brackets and the plurality of second brackets are arranged evenly below the concrete floor slab and fixed to the lower surface of the concrete floor slab by bolts.

Preferably, the plurality of first brackets and the plurality of second brackets are fixed to the lower surface of the concrete floor slab by high-strength bolts.

Preferably, the plurality of brackets are groove-shaped.

Preferably, each of the at least one framework comprises upper longitudinal rods, lower longitudinal rods, vertical rods and horizontal rods, wherein the upper longitudinal rods are fixed to the plurality of brackets on both sides of the top of the concrete beam along the length direction of the concrete beam, the lower longitudinal rods are disposed on both sides of the bottom of the concrete beam and fixed by the horizontal rods, the vertical rods are fixed between the upper longitudinal rods and the lower longitudinal rods, and ends of the upper longitudinal rods and the lower longitudinal rods are fixed to corresponding external columns.

Preferably, each of the at least one framework further comprises an inclined support disposed between the upper longitudinal rod and the lower longitudinal rod.

Preferably, the external column, the base plate, the brackets and the framework are made of a corrosion-resistant material.

Preferably, the external column, the base plate, the brackets and the framework are made of steel.

Preferably, the upper longitudinal rod is made of angle steel.

Preferably, the lower longitudinal rod, the vertical rod and the horizontal rod are made of structural steel.

Preferably, further comprised are a plurality of concrete piles disposed around the concrete column and a concrete cushion cap disposed on the top of the concrete piles, wherein the concrete cushion cap is located at the bottom of the concrete column, and the base plate is fixed to the concrete cushion cap and disposed around the concrete column.

Preferably, the base plate is fixed to the concrete cushion cap by expansion bolts.

Preferably, further comprised is a concrete beam slab disposed on a side of the concrete cushion cap, wherein the top surface of the concrete beam slab is flush with the concrete cushion cap.

Preferably, an anchor is disposed between and fixed to the top surface of the concrete beam slab and the base plate, and the anchor is made of a corrosion-resistant material.

Preferably, the anchor comprises a plurality of I-beams and steel plates disposed on the I-beams.

The principle of the present application is as follows: adopting a corrosion-resistant metal to reinforce a concrete member of an existing building can greatly prolong the service life of the concrete member, form a composite structure with new properties and achieve the organic combination of the concrete member and the corrosion-resistant metal member without changing the original building functions.

Compared with the prior art, the present application has the following advantages:

1. prolonged service lives of concrete buildings; and
2. environment-friendly.

Figure 1:
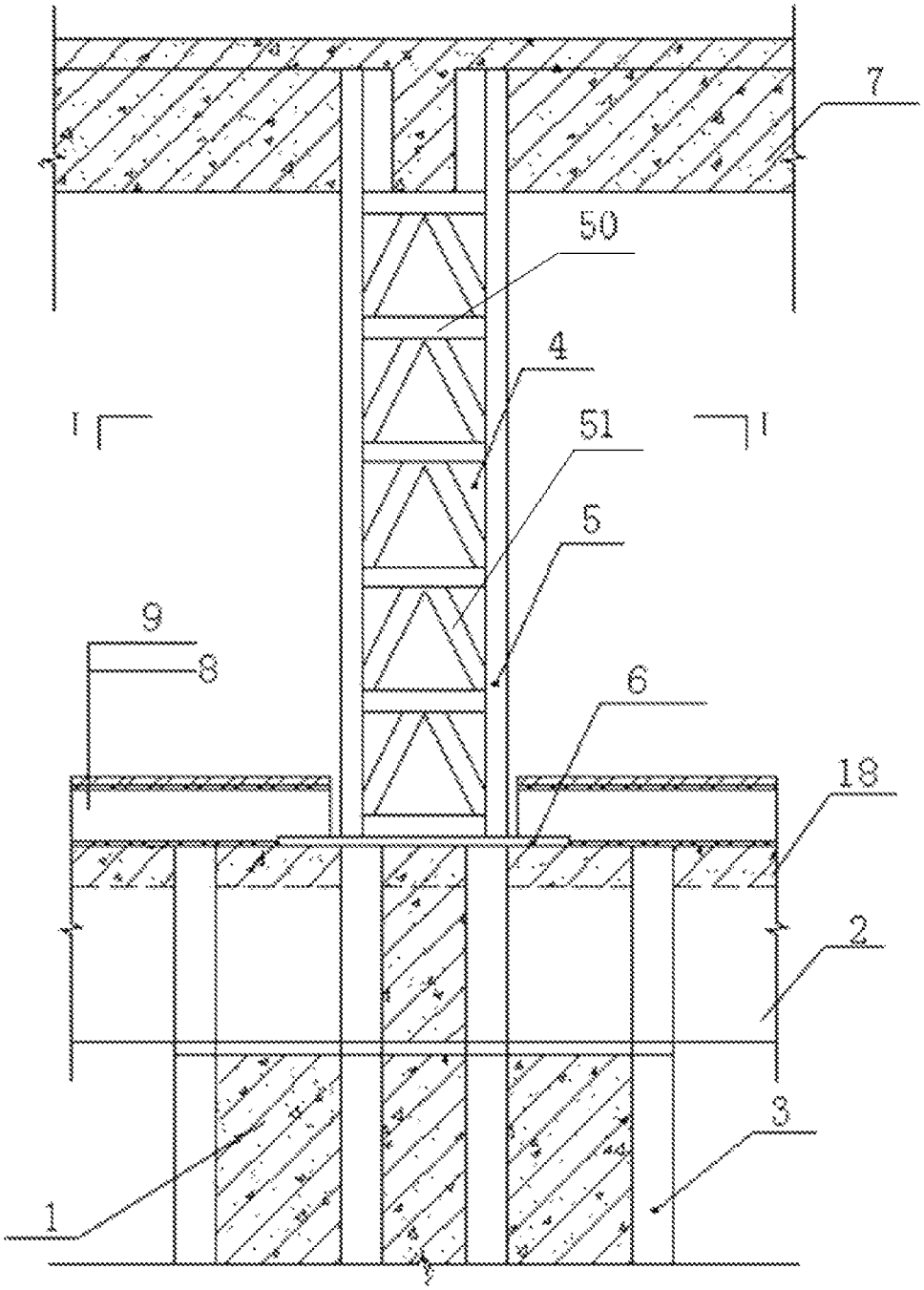
FIG. 1 is a schematic diagram of a reinforcing structure for a concrete column in one embodiment of the present application.

In the drawings, the reference numerals refer to the following: 1. concrete pile; 2. concrete cushion cap; 3. corrosion-resistant pile; 4. concrete column; 5. corrosion-resistant steel column; 6. steel base plate; 7. concrete beam; 8. corrosion-resistant I-beam; 9. corrosion-resistant steel plate; 50. steel column horizontal rod; 51. inclined support rod; 10. grooved steel bracket; 11. structural steel inclined support; 12. upper angle steel longitudinal rod; 13. lower structural steel longitudinal rod; 14. structural steel vertical rod; 15. structural steel horizontal rod; 16. X-direction grooved steel bracket; 17. Y-direction grooved steel bracket; 18. concrete beam slab; 19. high-strength bolt.

DETAILED DESCRIPTION OF THE PREFERRED EMBODIMENTS

The present application is further described in detail below with reference to FIGS. 1-5. FIG. 1 shows a concrete foundation of a building comprising concrete piles 1, a concrete column 4, a concrete beam slab 18 and a concrete cushion cap 2; the concrete cushion cap 2 is located on the top of the concrete piles 1, and the concrete beam slab 18 is disposed on one side of the concrete cushion cap 2 with its top flush with the concrete cushion cap 2; a steel base plate 6 is welded on a bottom of the concrete column 4, anchored on the concrete cushion cap 2 by expansion bolts and disposed around the concrete column 4; and corrosion-resistant piles 3 are disposed axially along the concrete piles 1 to reinforce the concrete piles 1.

Provided is a reinforcing structure for concrete floors of unexpired concrete building floors for reinforcing a concrete column 4, a concrete floor slab and a concrete beam 7.

Figure 2:
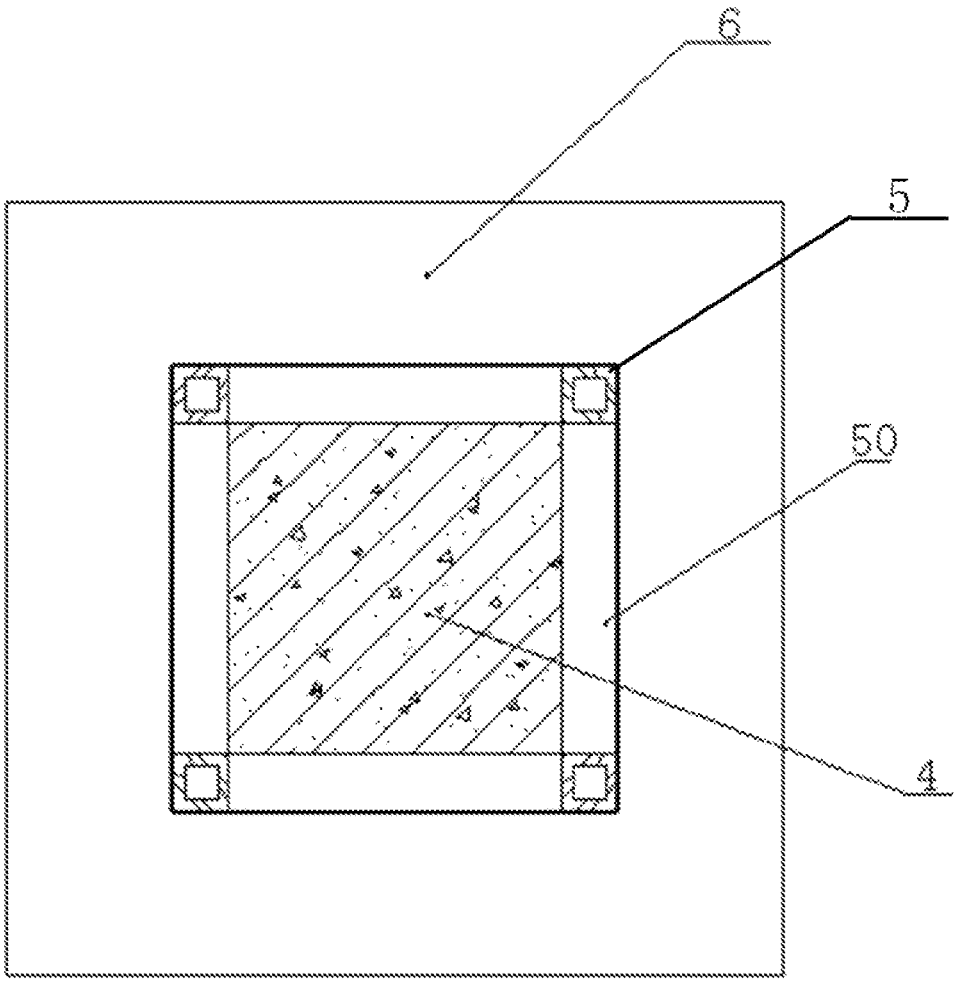
FIG. 2 is a I-I view of FIG. 1.

As shown in FIGS. 1-2, four corners of the concrete column 4 are wrapped by corrosion-resistant steel columns 5; the corrosion-resistant steel columns 5 extend vertically along the concrete column 4, and the bottoms of the corrosion-resistant steel columns 5 are fixed to the steel base plate 6 at one end of the concrete column by welding; steel column horizontal rods 50 and inclined support rods 51 are disposed between the corrosion-resistant steel columns 5; and the corrosion-resistant steel columns 5, the steel column horizontal rods 50 and the inclined support rods 51 together form a metal framework wrapping the concrete column 4, thus reinforcing the concrete column 4.

A plurality of corrosion-resistant I-beams 8 are mounted on the upper surface of the concrete beam slab 18 and corrosion-resistant steel plates 9 are laid on the corrosion-resistant I-beams 8 to reinforce the concrete beam slab 18.

Figure 3:
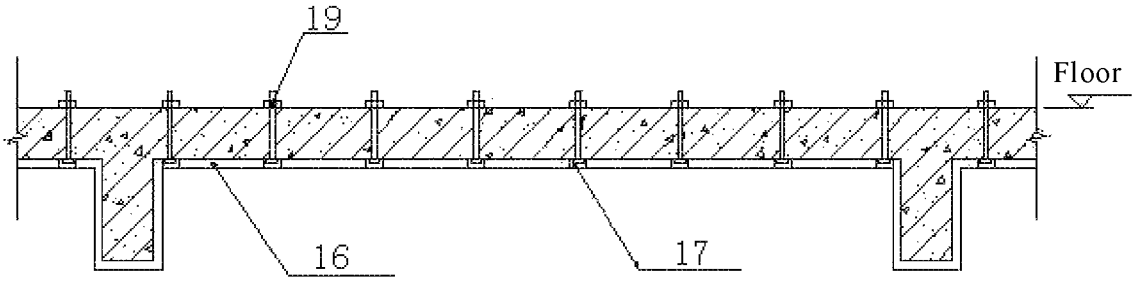
FIG. 3 is a schematic diagram of a reinforcing structure for a concrete floor slab in one embodiment of the present application.

As shown in FIG. 3, steel brackets are fixed to the lower surface of the concrete floor slab. The steel brackets are grooved steel brackets 10 comprising first channel steel brackets 16 and second channel steel brackets 17, wherein the first grooved steel bracket 16 and the second channel steel bracket 17 are perpendicular to each other, and both are arranged evenly under the concrete floor slab and fixed to the lower surface of the floor slab by high-strength bolts 19 to reinforce the concrete floor slab.

Figure 4:
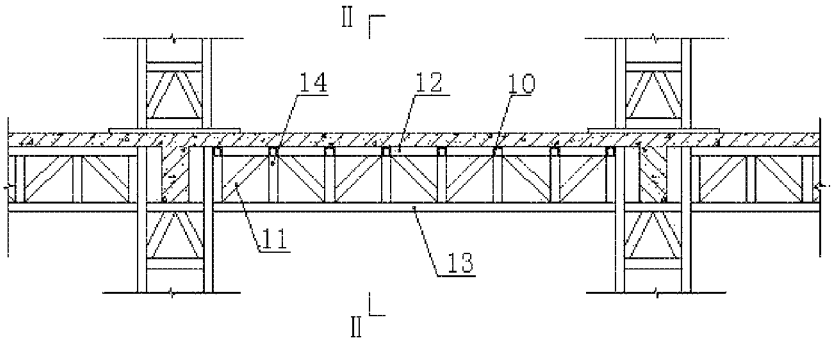
FIG. 4 is a schematic diagram of a reinforcing structure for a concrete beam in one embodiment of the present application.
Figure 5:
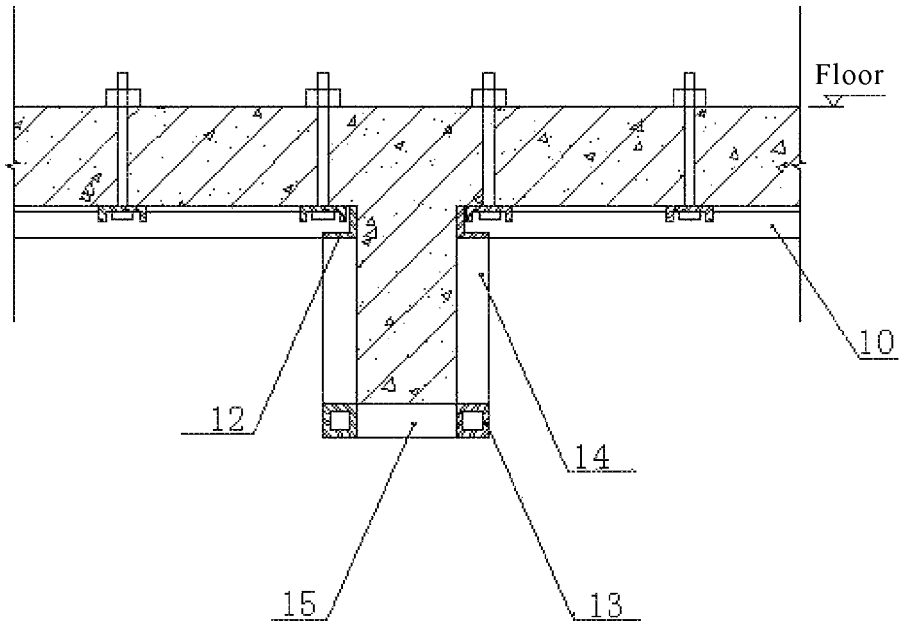
FIG. 5 is a II-II view of FIG. 4.

As shown in FIGS. 4-5, a metal framework is mounted fixedly under the concrete beam 7, and the metal framework comprises upper angle steel longitudinal rods 12, lower structural steel longitudinal rods 13, structural steel vertical rods 14 and structural steel horizontal rods 15; the upper angle steel longitudinal rods 12 are fixed to the steel brackets on both sides of the concrete beam with a length direction consistent with a length direction of the concrete beam; one end of the structural steel vertical rod 14 is fixed to the upper angle steel longitudinal rod 12, and the other end is fixed to the lower-structural steel longitudinal rod 13; the lower structural steel longitudinal rods 13 are located on both sides of the bottom of the concrete beam with a length direction consistent with a length direction of the concrete beam, and are fixed through connecting with the structural steel horizontal rods 15; the ends of the upper angle steel longitudinal rods 12 and the lower structural steel longitudinal rods 13 are fixed to the corrosion-resistant steel columns 5; and structural steel inclined supports 11 are disposed between the upper angle steel longitudinal rods 12 and the lower structural steel longitudinal rods 13.

A corrosion-resistant material is adopted for the steel column, the steel base plate, the steel bracket and the metal framework.

The aforementioned embodiments are only preferred embodiments of the present application and do not constitute a limitation for the present application. Those skilled in the art should understand that any variation and extension made without departing from the present application shall fall within the protection scope of the present application.

The invention claimed is:

1. A reinforcing structure of unexpired concrete building floors, used to reinforce a concrete column, a concrete beam and a concrete floor slab, comprising:

an external column, wrapping around the concrete column;

a framework, wrapping around the concrete beam;

a plurality of brackets, fixedly mounted to a lower surface of the concrete floor slab; and a base plate, disposed at the bottom of the concrete column, wherein, the bottom of the external column is fixed to the base plate, the top of the external column is fixed to the framework, and the framework is fixed to the plurality of brackets along a length direction of the concrete beam.

2. The reinforcing structure of unexpired concrete building floors according to claim 1, wherein the external column comprises a plurality of stand columns, and the plurality of stand columns extend vertically along the concrete column and wrap around the concrete column.

3. The reinforcing structure of unexpired concrete building floors according to claim 1, wherein the bottom of the external column is fixed to the base plate by welding.

4. The reinforcing structure of unexpired concrete building floors according to claim 2, wherein the plurality of stand columns are disposed respectively at corners of the concrete column.

5. The reinforcing structure of unexpired concrete building floors according to claim 2, wherein the bottom of each of the plurality of stand columns is fixed to the base plate.

6. The reinforcing structure of unexpired concrete building floors according to claim 2, wherein the external column further comprises a plurality of horizontal rods and a plurality of inclined support rods, the plurality of horizontal rods are spaced apart vertically along the concrete column and sequentially disposed between horizontally adjacent stand columns of the plurality of stand columns, and the plurality of inclined support rods are disposed between vertically adjacent horizontal rods of the plurality of horizontal rods.

7. The reinforcing structure of unexpired concrete building floors according to claim 1, wherein the plurality of brackets comprise a plurality of first brackets disposed along the length direction of the concrete beam and a plurality of second brackets respectively perpendicular to the plurality of first brackets, and the plurality of first brackets and the plurality of second brackets are disposed evenly under the concrete floor slab and fixed to the lower surface of the concrete floor slab.

8. The reinforcing structure of unexpired concrete building floors according to claim 6, wherein the plurality of first brackets and the plurality of second brackets are fixed to the lower surface of the concrete floor slab by bolts.

9. The reinforcing structure of unexpired concrete building floors according to claim 1, wherein the plurality of brackets are groove-shaped.

10. The reinforcing structure of unexpired concrete building floors according to claim 1, wherein the framework comprises upper longitudinal rods, lower longitudinal rods, vertical rods and horizontal rods, wherein the upper longitudinal rods are fixed to the plurality of brackets on opposite sides of the top of the concrete beam along the length direction of the concrete beam, the lower longitudinal rods are disposed on opposite sides of the bottom of the concrete beam and fixed by the horizontal rods, the vertical rods are fixed between the upper longitudinal rods and the lower longitudinal rods, and ends of the upper longitudinal rods and the lower longitudinal rods are fixed to the external column.

11. The reinforcing structure of unexpired concrete building floors according to claim 10, wherein the framework further comprises inclined supports disposed between the upper longitudinal rods and the lower longitudinal rods.

12. The reinforcing structure of unexpired concrete building floors according to claim 1, wherein the external column, the base plate, the brackets and the framework are made of a corrosion-resistant material.

13. The reinforcing structure of unexpired concrete building floors according to claim 1, wherein the external column, the base plate, the brackets and the framework are made of steel.

14. The reinforcing structure of unexpired concrete building floors according to claim 10, wherein the upper longitudinal rod is made of angle steel.

15. The reinforcing structure of unexpired concrete building floors according to claim 10, wherein the lower longitudinal rod, the vertical rod and the horizontal rod are made of structural steel.

16. The reinforcing structure of unexpired concrete building floors according to claim 1, further comprising a plurality of concrete piles disposed around the concrete column and a concrete cushion cap disposed on the tops of the concrete piles, wherein the concrete cushion cap is located at the bottom of the concrete column, and the base plate is fixed to the concrete cushion cap and disposed around the concrete column.

17. The reinforcing structure of unexpired concrete building floors according to claim 16, wherein the base plate is fixed to the concrete cushion cap by expansion bolts.

18. The reinforcing structure of unexpired concrete building floors according to claim 16, further comprising a concrete beam slab disposed on one side of the concrete cushion cap, wherein the top surface of the concrete beam slab is flush with the concrete cushion cap.

19. The reinforcing structure of unexpired concrete building floors according to claim 18, wherein an anchor is disposed fixedly between the top surface of the concrete beam slab and the base plate, and the anchor is made of a corrosion-resistant material.

20. The reinforcing structure of unexpired concrete building floors according to claim 19, wherein the anchor comprises a plurality of I-beams and steel plates disposed on the I-beams.

* * * * *